US005867317A

United States Patent [19]

Elie et al.

[11] Patent Number: 5,867,317

[45] Date of Patent: Feb. 2, 1999

[54] STABILIZED OPTICAL SIGHTING SYSTEM

[75] Inventors: Philippe Elie, Versailles; Jean-Yves Le Cardinal, Ermont, both of France

[73] Assignee: Sagem SA, Paris, France

[21] Appl. No.: 715,703

[22] Filed: Sep. 19, 1996

[30] Foreign Application Priority Data

Sep. 19, 1995 [FR] France ..... 95 10967

[51] Int. Cl.[6] ..... G02B 27/64; G02B 7/182

[52] U.S. Cl. ..... 359/555; 359/554; 359/876

[58] Field of Search ..... 359/554–557, 359/900; 250/871–876, 203.1, 203.2, 203.6; 33/230–240, 275 R

[56] References Cited

U.S. PATENT DOCUMENTS

| | | | |
|---|---|---|---|
| 4,393,597 | 7/1983 | Picard et al. | 33/275 G |
| 4,491,397 | 1/1985 | Barthelat et al. | 359/557 |
| 4,881,800 | 11/1989 | Fuchs et al. | 359/554 |
| 4,883,347 | 11/1989 | Fritzel | 359/555 |
| 4,973,144 | 11/1990 | Malige | 359/554 |
| 5,203,220 | 4/1993 | Lerman | 359/555 |

FOREIGN PATENT DOCUMENTS

WO82/00515 2/1982 WIPO .

*Primary Examiner*—Thong Nguyen

*Attorney, Agent, or Firm*—Jacobson, Price, Holman & Stern, PLLC

[57] ABSTRACT

The sighting system has a sight including an aiming mirror (16) which is steered about a circular axis that is fixed relative to a support secured to a carrier, and about an elevation axis (18) under the control of motors (15, 22) to bring the direction of light which is received along a reference sighting line in a geographical frame of reference (x, y, z) to the direction of the circular axis, and measurement device for measuring the real angles imparted to the aiming mirror (16) about circular and lateral axes by the motors. A gyro unit continuously delivers angles for converting the reference frame of reference (x, y, z) to a frame of reference tied to the support (x1, y1, z1). A computer and servo-control unit controls the motors (15, 22) on the basis of information received from the gyro unit (60) and from the measurement device. This unit is designed to compute and transmit to a user device the real position of the sighting line on the basis of information supplied by the measurement device and on the basis of stored parameters modelling at least the optical and mechanical defects of the sight.

6 Claims, 7 Drawing Sheets

STABILIZED OPTICAL SIGHTING SYSTEM

BACKGROUND OF THE INVENTION

The present invention relates to a stabilized optical sighting system for mounting on a carrier vehicle which, as it moves, is subjected to disturbing roll, pitch, and yaw movements. A particularly important application is on board ships where such disturbances are practically continuous and can be of large amplitude. Nevertheless, the invention is applicable to any medium subjected to such movements, in particular for making sighting systems that enable panoramic surveillance to be performed, i.e. the line of sight should be maintained at an angle of elevation that is constant relative to the horizon while simultaneously causing the line of sight to rotate about an axis that is vertical. The term "optical" should be understood broadly as covering both infrared sighting and sighting in the visible range.

Stabilized optical sighting systems are known that comprise a sensor mounted on a platform that is kept fixed relative to a geographical frame of reference by mounting the system on gimbals provided with motors controlled on the basis of information provided by a navigation control center. The sensor and the platform supporting it together have a large amount of inertia; that degrades the dynamic behavior of the system and requires motors of considerable power.

Consequently, the invention relates to a stabilized sighting system of a type that reduces the inertia of the moving parts comprising an aiming mirror whose orientation about an elevation axis and about a "circular" axis that is fixed relative to a platform secured to the carrier, is controlled to bring the direction of light received along a sighting line that is determined in a geographical frame of reference to a direction that is constant relative to the support, said constant direction being that of the circular axis in the frequent case of a panoramic system.

Often the aiming or sighting mirror is also steerable about a "lateral" axis which is parallel to the circular axis at zero elevation. This structure makes it possible, in particular, to provide a panoramic sight whose mirror is driven at constant speed about the circular axis, with any disturbing movements that tend to alter the angle of elevation being compensated by controlling both a motor for rotating the mirror about the elevation axis and a motor for rotating it about the lateral axis.

FIG. 1 is a diagram showing the theoretical structure of such a system having a lateral axis, together with the parameters involved in controlling it, and the notation that is used below, this figure not being to scale.

The system comprises a sight proper placed at the top of a mast 10 fixed to the deck of the ship 12. It has a head 14 which is steerable by a motor 15 about a circular axis $z_1$ perpendicular to the deck and relative to a platform 32 which is fixed to the mast. In FIG. 1, $x_1$ designates the longitudinal axis of the ship (lubber's line), and $y_1$ the axis lying in the plane of the deck and extending orthogonally to $x_1$ and $z_1$. In the head 14, an aiming member constituted by an aiming mirror 16 is steerable both about an elevation axis 18 perpendicular to the circular axis, and about a lateral axis 20 perpendicular to the elevation axis 18. Rotation about the elevation axis 18 is controlled by an elevation motor 22. The output shaft of this motor carries a support 24 both for the lateral axis 20 and for the lateral motor 26 which controls rotation of the aiming mirror about the lateral axis. A deflecting optical assembly 28 deflects the light path so that light leaves the sight substantially along the circular axis.

The deflection is generally through 90°. The beam of light coming from the direction of the sighting line 30 is thus successively reflected by the aiming mirror 16 and deflected by the assembly 28.

The sighting line 30 can be defined by a [true] elevation angle Si and by an azimuth angle Az in a geographical frame of reference xyz.

The laws for controlling rotation about the circular, elevation, and lateral axes are much more complex than the laws for controlling a platform to keep it fixed relative to a geographical frame of reference, in particular because the lateral axis is moved by the elevation axis. The rate of rotation to be imparted about the circular axis $z_1$ relative to the ship differs from the azimuth rate to be imparted relative to the terrestrial frame of reference xyz because of the roll, pitching, and yaw movements of the ship. In order to perform panoramic scanning at constant elevation and at substantially constant azimuth rate, the steering angles about the circular, elevation, and lateral axes must all vary continuously. Computing them in real time by successive approximation methods requires very high computation power, given the inevitable defects of the system.

SUMMARY OF THE INVENTION

An object of the invention is to provide a stabilized optical sighting system of the above-defined type that satisfies practical requirements better than do previously known systems, in particular in that it makes it possible significantly to reduce the complexity of the computation to be performed while still ensuring that the sighting line remains at constant elevation.

To do this, the invention accepts certain constraints, and in particular the fact that the outlet from the optical path is steered about one of the axes of the sighting system (typically the circular axis), and that certain defects of the sighting system (perpendicularity defect, optical imperfections, influence of inlet port-hole) can be measured once and for all during a prior commissioning stage and can then be represented by rotation matrices.

Consequently, the invention provides a sighting system having:

- a stabilized sighting system having a sight proper including an aiming mirror which can be steered under the control of motors both about an elevation axis and about a circular axis that is fixed relative to a support secured to a carrier, so as to bring the direction of light which is received along a reference sighting line in a geographical frame of reference to the direction of the circular axis, measurement device for measuring the real angles imparted to the aiming mirror by the motors about circular and lateral axes, and a gyro unit enabling angles to be computed continuously for converting the geographical frame of reference to a frame of reference tied to the support; and
- a computer and servo-control unit controlling the motors on the basis of information received from the gyro unit and the measurement device.

The unit is designed to compute the real position of the sighting line on the basis of information provided by the measurement device and on the basis of stored parameters modelling at least the optical and mechanical defects of the sight.

In this way, the servo-controls can be operated at high frequency without it being necessary to solve a system of equations by successive approximations, but they provide no more than a good approximation. The defects of the system (defects of perpendicularity between axes, servo-control errors, optical defects) are then taken into account not for the purpose of correcting the servo-controls, but merely for real-time computing of the exact position of the sighting line. This position is transmitted to a user device, e.g. serving to display successive images coming from the sight while repositioning the images relative to one another in correct manner.

The invention is applicable regardless of whether the sight has a lateral axis about which the aiming mirror can be steered.

The computing unit is programmed to repeat a servo-control and computing sequence in real time. Each sequence can be regarded as comprising three stages:

1) computing the set value and servo-controlling the circular axis;
2) computing the set value and servo-controlling the elevation axis (and possibly also the lateral axis) on the basis of set values for [true] elevation (and azimuth) and on the basis of the measured value $Ci_m$ of rotation about the circular axis; and
3) computing the real position of the sighting line on the basis of measured values $Ci_m$ and $El_m$ (and possibly also $La_m$) for the angles of rotation about the circular, elevation, and optionally lateral axes (Ci, El, and optionally $La_m$).

The angles obtained are delivered to a module which makes use of them, e.g. for visual indication or display.

The invention is of particular advantage for sighting systems that are to perform panoramic surveillance at constant elevation and at an azimuth speed that is as constant as possible. Often the optical sensors are constituted by opto-electronic sensors in the form of strips for light integration and having an angular field of view in the azimuth direction that is very small. It is desirable to control reading of such optical sensors at intervals that correspond to equal amounts of angular advance in the azimuth direction. The invention makes it possible to achieve this result in simple manner because the computation unit fully identifies the real orientation in azimuth of the sighting line at all instants. A read pulse generator can be connected to the output of the unit so as to cause the sensors to be read at instants which are not uniformly distributed in time, but which correspond to azimuth intervals which are equal.

The above characteristics and other characteristics appear more clearly on reading the following description of a particular embodiment, given by way of non-limiting example. The description refers to the accompanying drawings.

DETAILED DESCRIPTION OF PREFERRED EMBODIMENTS

Figure 1:
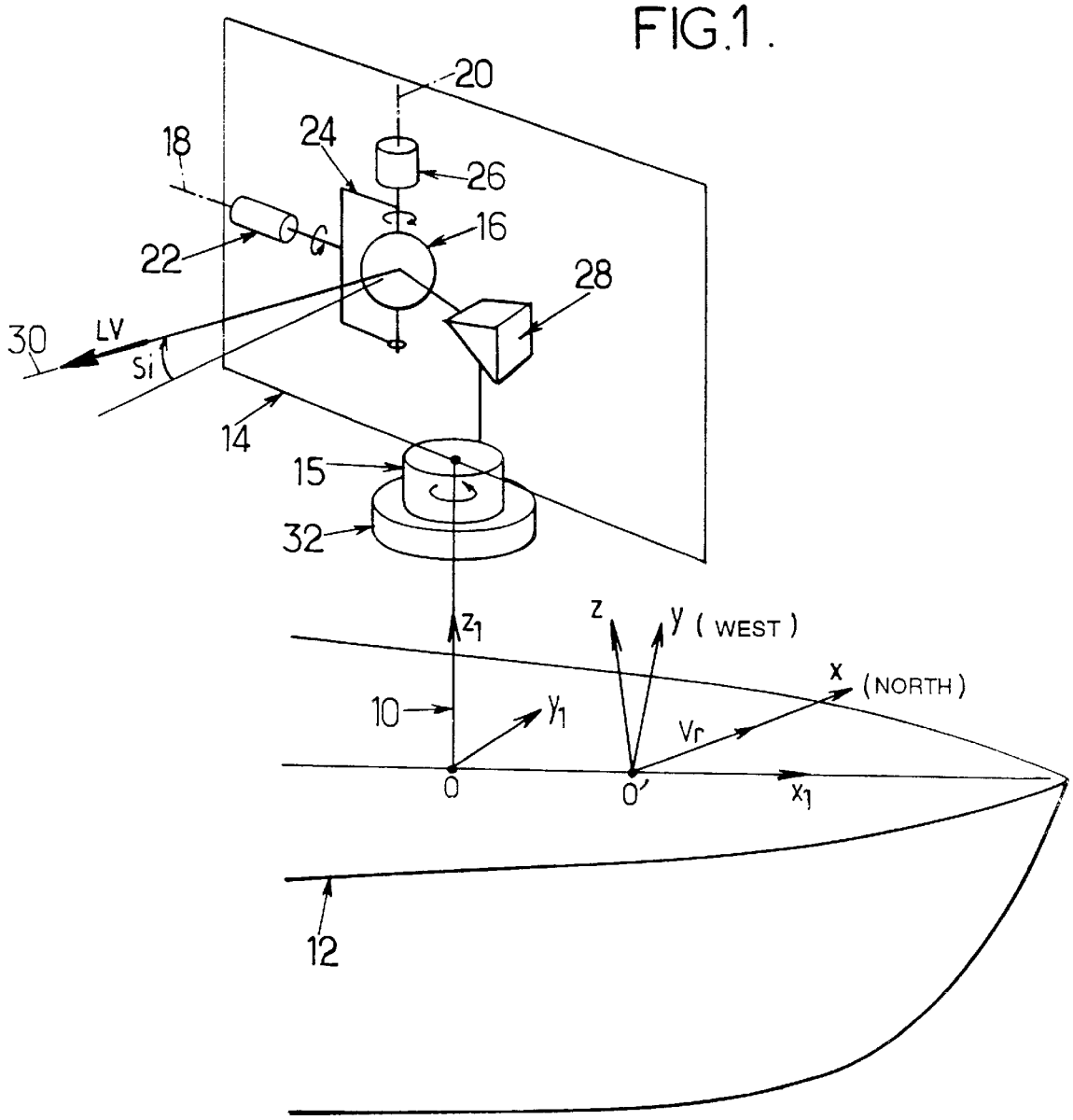
FIG. 1, described above, is a theoretical diagram for showing the parameters involved in the physical disposition of the sighting system when it includes a lateral axis.

In the explanation below, the following notation is used:

xyz=geographical frame of reference with its origin at the center of the carrier, but tied to the earth (where the axes x, y, and z are typically north, west, and vertical);

$x_1y_1z_1$=the frame of reference tied to the carrier, constituted by its longitudinal axis (lubber's line), its transverse axis, and the axis perpendicular to the deck if the carrier is a ship, the axis $z_1$ differing from the circular axis only by a small angular off-set error;

LV=the director vector of the sighting line in the $x_1y_1z_1$ frame of reference tied to the carrier;

Vr=the reference vector along the x-axis in the xyz frame of reference;

[Az]=the azimuth rotation matrix (about the z-axis);

[Si]=the [true] elevation rotation matrix;

K,T,R=angles of rotation (heading, pitch, and roll) for converting from the local geographical reference xyz to the reference $x_1y_1z_1$ tied to the carrier;

Ci,La,El=angles of rotation about the circular, lateral, and elevation axes enabling the sighting line to be steered to a chosen direction;

th=a subscript marking a computed value; and m=a subscript marking a measured value.

For purposes of simplification, it is assumed below that there is no rotation about the lateral axis.

The director vector LV and the reference vector Vr are related by the following relationship:

$$LV=[(Si)*(Az)]*VR \quad (1)$$

$$LV=[(La_{th})*(El_{th})*(Ci_{th})*(R)*(T)*(K)]*Vr \quad (2)$$

In a first computation stage, it is desired to control the circular axis by the value which will achieve a zero lateral angle so as to limit motion thereabout.

When $La_{th}=0$, equation (2) becomes:

$$LV=[(El_{th})*(Ci_{th})*(R)*(T)*(K)]*Vr \quad (3)$$

Equations (1) and (3) give:

$$(El_{th})*(Ci_{th})=(Si)*(Az)*(K)^{-1}*(T)^{-1}*(R)^{-1} \quad (4)$$

Equation (4) enables theoretical rotations to be computed in elevation and about the circular axis.

In equation (4), the product of the five matrices on the righthand side gives a matrix of dimensions 3×3, and the product of the two matrices on the lefthand side gives a matrix having the same dimensions 3×3. By matching the two matrices of equation (4) term by term, $El_{th}$ and $Ci_{th}$ are computed in independent manner, thereby obtaining the looked-for magnitude $Ci_{th}$.

In a second stage, it is desired to control the elevation and lateral axes knowing (Si), (Az), (K), (T), and (R) and the measured value about the circular axis $Ci_m$. $Ci_{th}$ in equation (2) is replaced by $Ci_m$, giving:

$$LV=[(La_{th})*(El_{th})*(Ci_m)*(R)*(T)*(K)]*Vr \quad (5)$$

Equations (1) and (5) give:

$$(La_{th})*(El_{th})=(Si)*(Az)*(K)^{-1}*(T)^{-1}*(R)^{-1}*(Ci_m)^{-1} \quad (6)$$

For the same reasons as for equation (4), equation (6) enables $La_{th}$ and $El_{th}$ to be computed separately and they are used in the corresponding servo-control.

The set values for Si and Az may vary in time. For example when performing panoramic surveillance, Si is constant while Az is a linear function of time.

K, T, and R are measured and computed by integrating measured angular rates. Often they are provided by a "strap-down" gyro unit 60 carried by the platform 32 constituting the support of the sight. On a ship, this unit may be periodically reset by the on-board heading and vertical navigation unit (CCV) to avoid long-term drift.

There follows a description of the process implemented by a computer forming part of the system in order to generate directly, i.e. without successive approximations, the circular and elevation angles, and to supply these values to the motors in order to perform servo-control, and also to output corrected [true] elevation and azimuth values, taking account of the imperfections of the system.

1) The first stage of the process includes a first computation which is the same regardless of whether or not there is a lateral axis; it comprises initially solving equations by assuming that the lateral angle is zero, thereby giving the theoretical value that the circular angle ought to have if there were no errors; this is a rough evaluation since no account is taken of imperfections.

Figure 2:
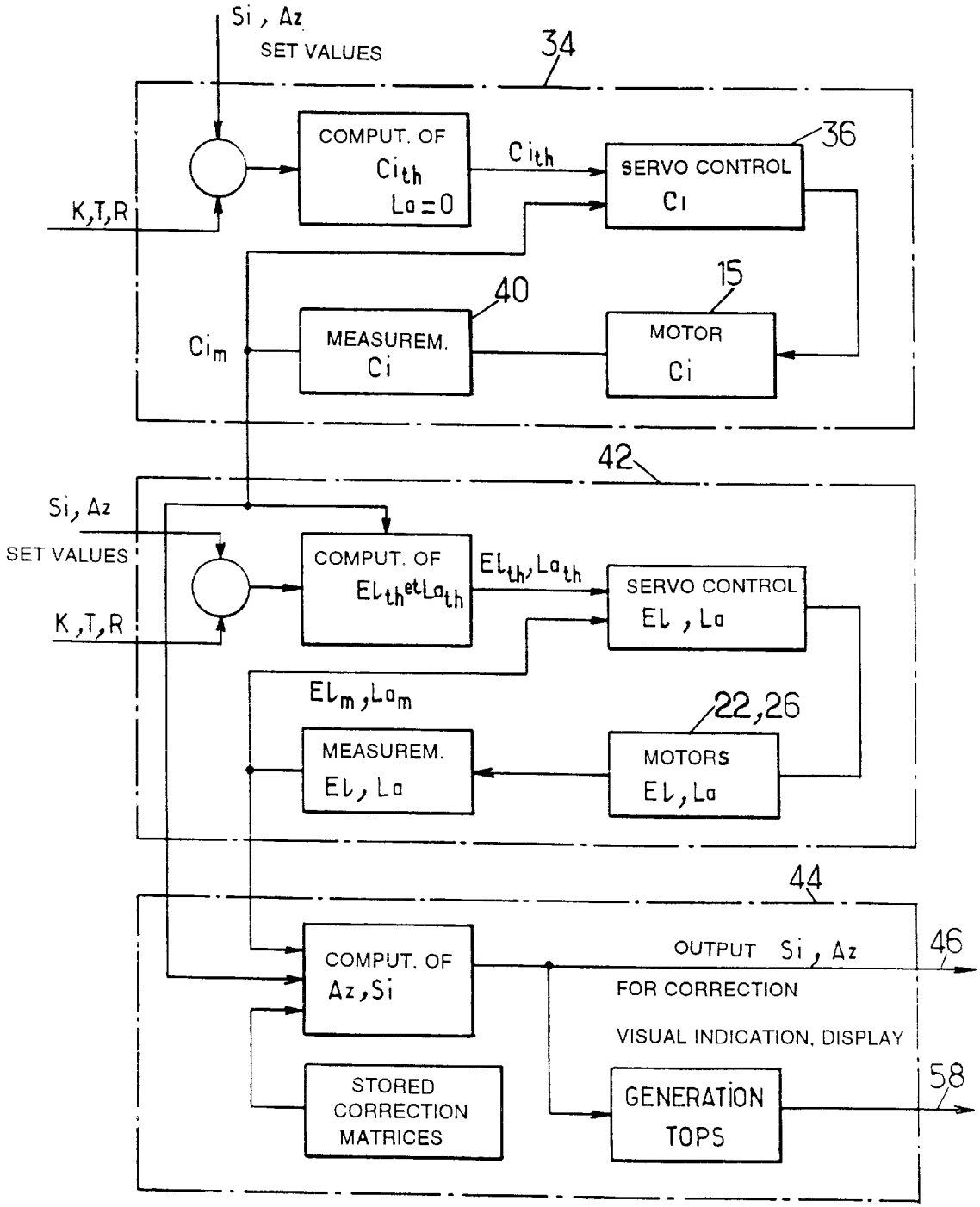
FIG. 2 is a diagram showing the operation of a sighting system including a lateral axis.
Figure 3:
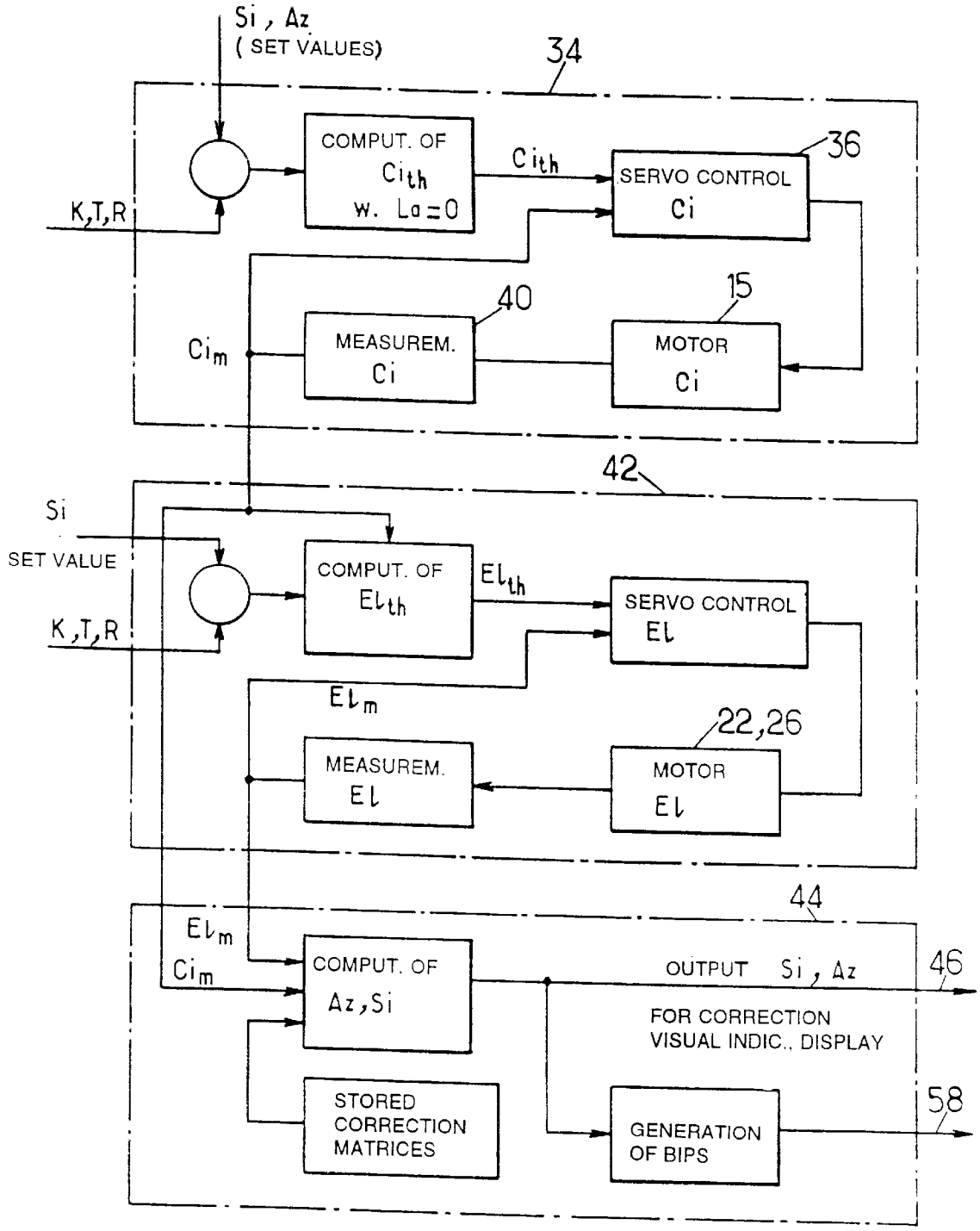
FIG. 3 is similar to FIG. 2, but corresponds to a sighting system that does not include a lateral axis.

This computation of the circular angle is based on equation (4) and is represented by box 34 in FIGS. 2 and 3. On the basis of K, T, and R as provided by the gyro unit and on the basis of set values (Si) and (Az), the computer supplies a theoretical value $Ci_{th}$ for the circular angle to a servo-circuit 36 for controlling Ci by controlling the circular axis motor represented by block 15.

2) An angle sensor, represented by block 40, delivers the real value $Ci_m$ which is used firstly for feed back to the servo-control and secondly in a second computation 42 which differs depending on whether or not there is a lateral axis.

(a) A sight having a lateral axis (FIG. 2)

During the second computation 42, the theoretical values $El_{th}$ and $La_{th}$ are computed on the basis of the measured value for $Ci_m$, again by applying equation (4). These computations can still be considered as being "rough", since they do not take all defects into account.

At the end of this second operation (second computation and servo-control), the computer has measured values $El_{th}$ and $La_{th}$ which it applies to a servo-circuit controlling the elevation and lateral motors.

(b) A sight without a lateral axis (FIG. 3)

In this case, the second computation takes account only of the set value for elevation; it also makes use of the measured value $Ci_m$, and it delivers a theoretical value $El_{th}$ for the elevation angle to the servo-control circuit which controls the elevation motor.

(3) Computing the elevation and azimuth angles of the sighting line as actually obtained.

Because of defects, the angles obtained are not exactly the set values for the angles Si and Az.

A second stage 44 serves to determine the real elevation and azimuth angles of the sighting line and to supply them on an output 46 leading to a visual indicator or display module.

During this computation, defects are taken into account, as represented by rotation matrices, such as the following:

- orthogonality defects between the circular axis and the elevation axis;
- orthogonality defects between the lateral axis and the elevation axis (if there is a lateral axis);
- interfering errors on El, La, and Ci due to the optical system (e.g. a port-hole that imparts varying parasitic deflections); and
- the influence of other elements such as a derotator if one is provided for eliminating tilt.

The real position of the sighting line 30 is computed directly by taking the defects into account. This computation is not coupled from the first stage and makes use only of the results obtained during said first stage, being restricted to computing a matrix product; no equations are solved.

For example, if the defects can be represented by two matrices that are determined once and for all by preliminary calibration and are then stored in the computer:

- (D1): error or defect matrix between the lateral and elevation axes (e.g. orthogonality defect); and
- (D2): error or defect matrix concerning orthogonality between the circular axis and the platform supporting the circular axis;

then the real director vector $LV_r$ is given by:

$$i\ LV_r=[(La)*(D1)*(El)*(Ci)*(D2)*(R)*(T)*(K)]*Vr \quad (7)$$

while the measured director vector $LV_m$ is:

$$LV_m=[(La_m)*(D1)*(El_m)*(Ci_m)*(D2)*(R)*(T)*(K)]*Vr \quad (8)$$

Equation (8) constitutes an approximation to equation (7), i.e. it gives an estimate of $LV_s$; the following can be written:

$$LV_m=[(Si_m)*(Az_m)]*Vr \quad (9)$$

Equations (8) and (9) give:

$$(Si_m)*(Az_m)=(La_m)*(D1)*(El_m)*(Ci_m)*(D2)*(R)*(T)*(K) \quad (10)$$

Equation (10) makes it possible to compute with good accuracy the real elevation and azimuth from the values of K, T, and R, the coefficients of the defect matrices, and the values $El_m$, $La_m$, and $Ci_m$ as measured by angle sensors mounted on the axes and also participating in servo-control (references 40 and 43 in FIGS. 2 and 3).

The product of the two matrices on the lefthand side of equation (10) gives a matrix of dimensions 3×3; the product of the eight matrices on the righthand side of equation (10) gives a matrix having the same dimensions 3×3. Term by term matching in equation (10) makes it possible to compute $Si_m$ and $Az_m$ in independent manner.

Figure 7:
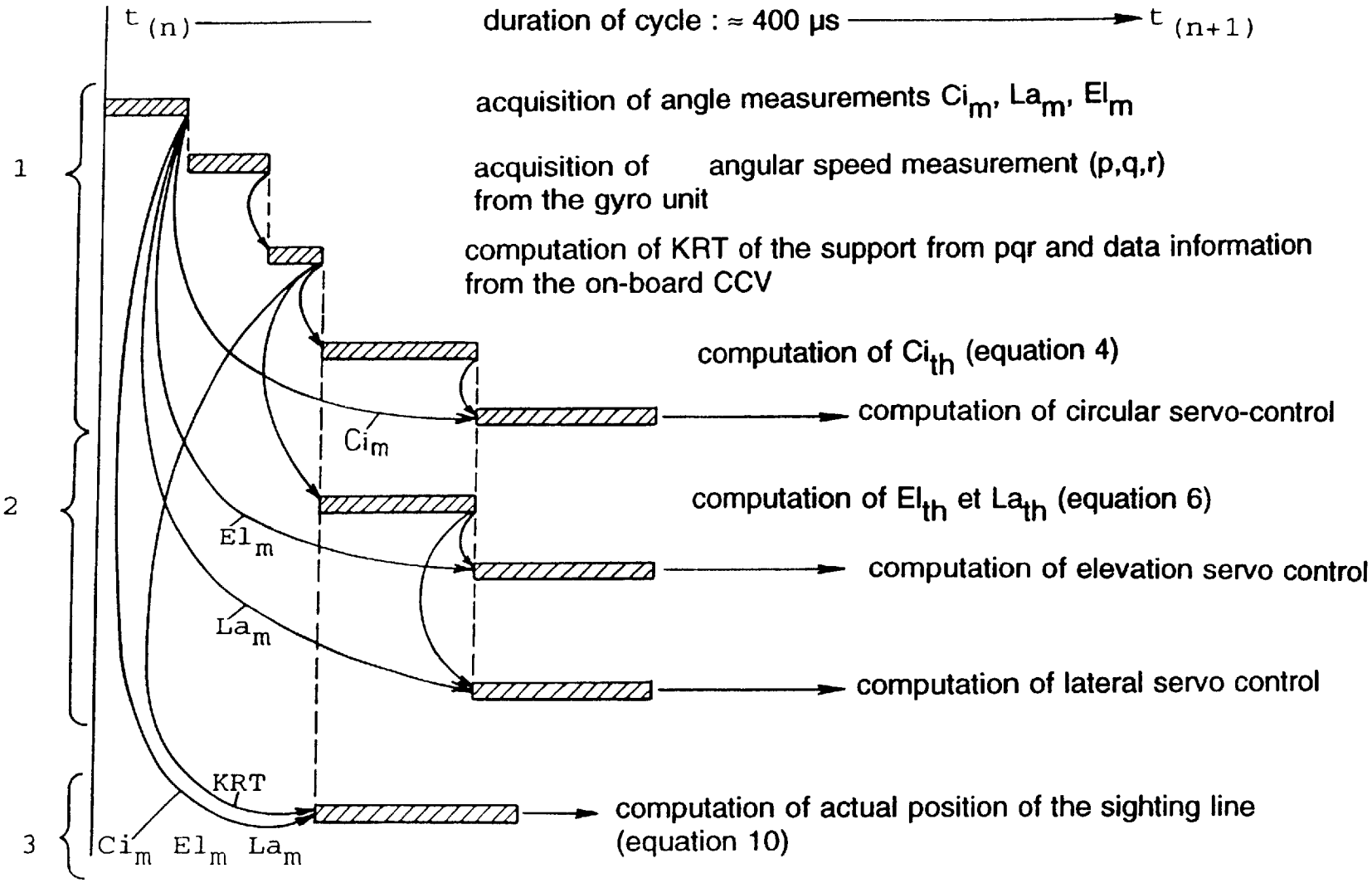
FIG. 7 shows one possible way of spacing out the computations.

As shown diagrammatically in FIG. 7, the computations can be distributed as follows.

Stage 1

Measure and acquire the circular angle $Ci_m$.

Acquire angular rate values p, q, and r from the gyro unit.

Compute K, R, and T at instant $T_n$.

Compute the value of $Ci_{th}$ from the set values (Si, Az) and from K, R, and T using equation (4).

Compute circular servo-control by incorporating correcting networks that guarantee loop stability.

Stage 2

Measure and acquire the lateral and elevation angles $La_m$ and $El_m$.

Compute the values $El_{th}$ and $La_{th}$ from the set values (Si, Ar) and from K, R, and T and from $Ci_m$ using equation (6).

Compute lateral and elevation servo-control, incorporating correcting networks guaranteeing loop stability.

Stage 3

Compute the real position of the sighting line from $Ci_m$, $La_m$, $El_m$, K, R, T, and the rotation matrices representing geometrical defects, using equation (10).

An advantage lies in the fact that the computations are independent from time To+Δt and they can be performed in parallel by different microcomputers.

As a result, the cycle time can be very short (e.g. about 400 μs).

Figure 5:
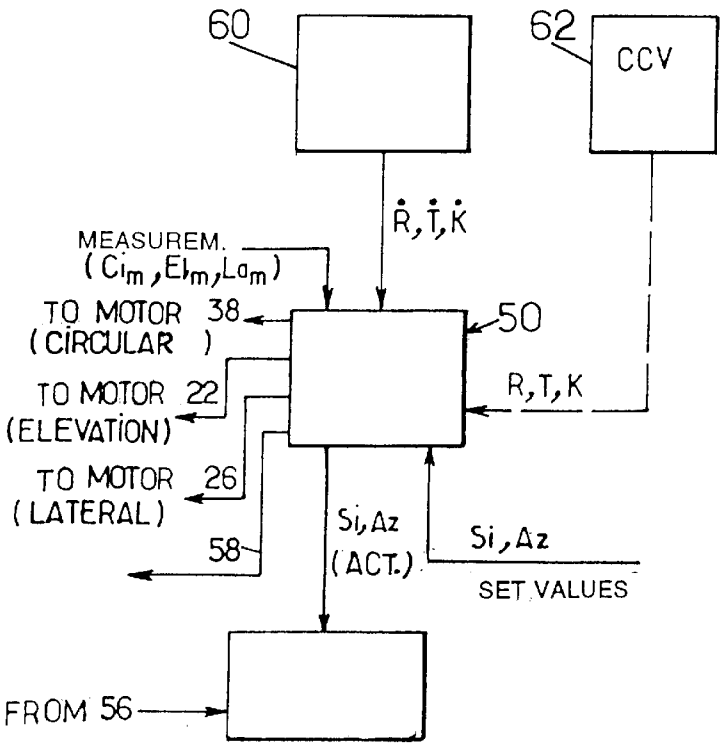
FIG. 5 is a block diagram for the electronics associated with the sight.
Figure 4:
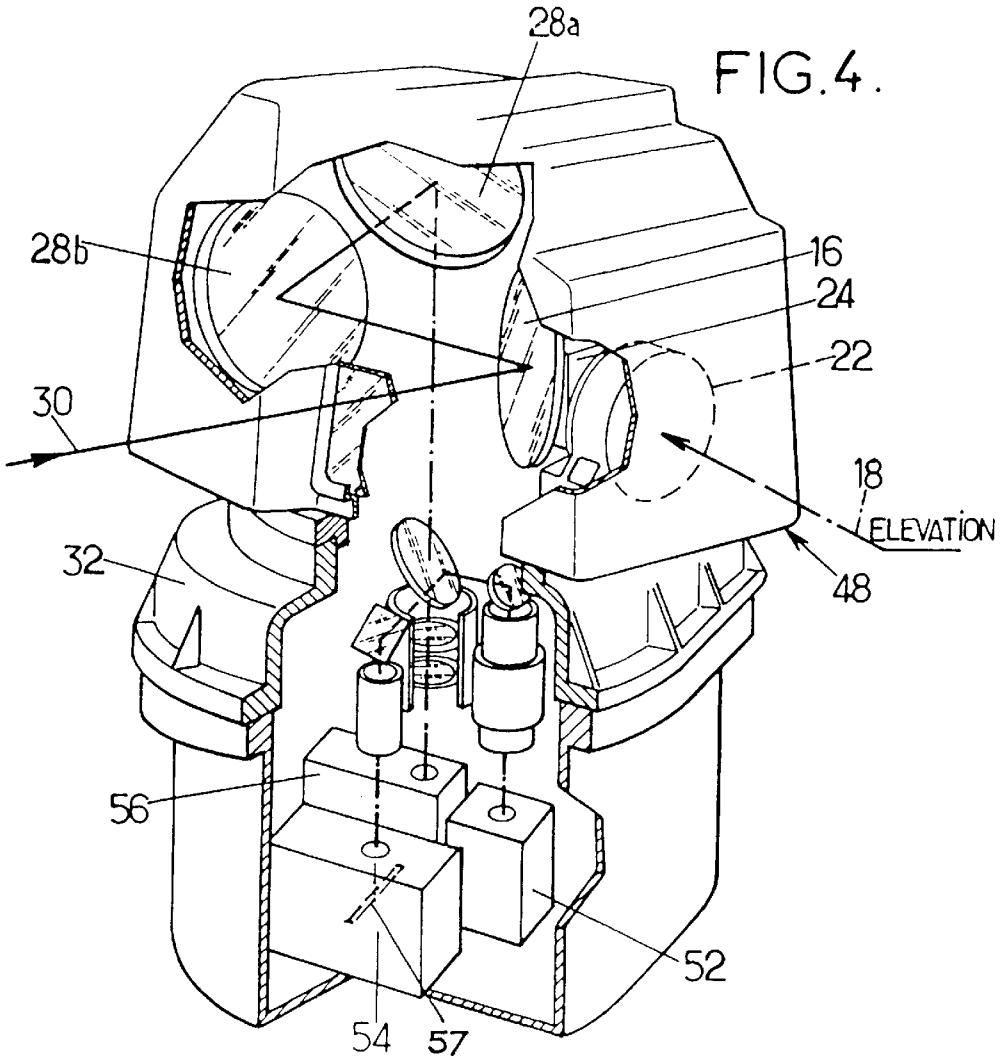
FIG. 4 is a simplified illustration of a sight usable in a stabilized sighting system of the invention.

The physical structure of the panoramic sighting system may be as shown in FIGS. 4 and 5 where elements corresponding to those described above are designated by the same reference numerals. The platform 32 contains the optical sensors and the motor (not shown) for driving a moving head 48 about the circular axis. Two fixed mirrors 28*a* and 28*b* are placed in the head and constitute the optical deflector system for deflecting the optical path through 90°, the head also contains the aiming mirror 16. Sensors are placed on the measurement axis $Ci_m$, $El_m$, and $La_m$ and provide signals representative of those values to a computer unit 50 (FIG. 5) described below.

In the embodiment shown in FIG. 4, the platform 32 of the sight contains dichroic or semitransparent plates which split the beam that penetrates therein along the circular axis and steers the fractions to various optoelectronic sensors such as:

a visible range sensor 52;

an infrared range sensor 54 (for 3μ to 5μ); and an infrared range sensor 56 (for 8μ to 12μ).

Each fraction can pass through a de-rotator (not shown) whose function is described below.

The various sensors may include a strip of CCD cells such as 57 having a field of a few degrees in elevation (corresponding to the length of the strip) and that is very small in azimuth. In this case, an image is formed only while the head is rotating (or if a scanning mirror is provided). Successive acquisitions are performed at instants determined by acquisition pulses coming from an output 58 of the unit 50.

The electronic portion of the system includes the unit 50 which receives the signals from the gyro unit 60 fixed on the platform and which also provides rates of rotation (but not angles) concerning heading, pitch, and roll, respectively written K-dot, T-dot, and R-dot.

The unit continuously computes K, T, and R on the basis of the above data and periodically resets them using information provided by the on-board navigation unit 62 for determining heading and the vertical direction via a feedback filter having a time constant that is long relative to the carrier.

The unit 50 makes use of the following:

firstly, the set values constituted by the elevation to be maintained Si and by the scan rate Az if panoramic surveillance is being performed; and secondly, the measured values $Ci_m$, $El_m$, and $La_m$ coming from the sensors placed on those axes in order to generate control signals for the motors 15, 22, and 26.

Figure 6:
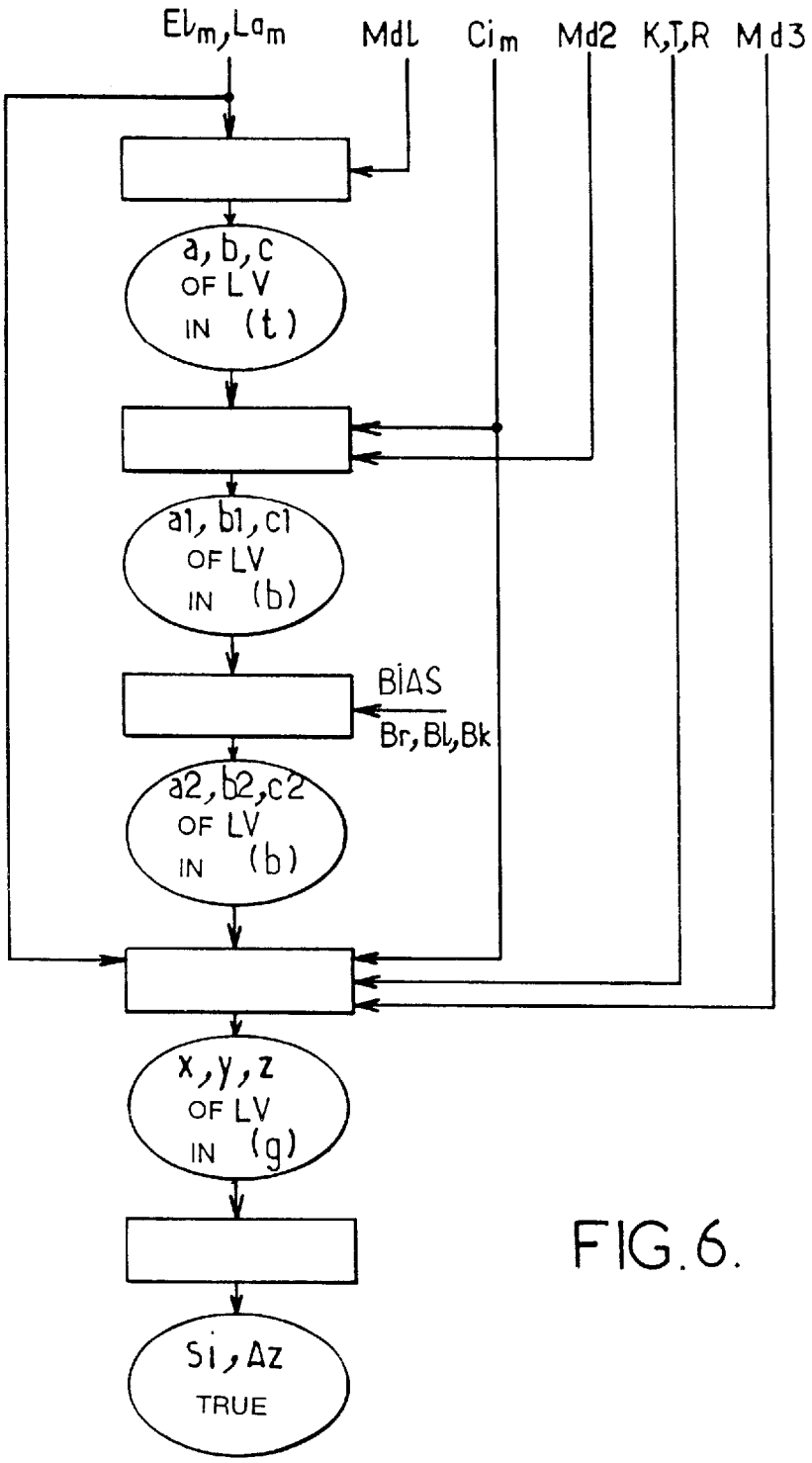
FIG. 6 is a flow chart showing the operations involved during the third computation when implementing the invention in a particular embodiment thereof.

The corrections can be computed using the flow chart of FIG. 6 which takes three types of error into account:

firstly, perpendicularity error between the lateral and elation axes as modelled by a matrix $Md_1$;

secondly, perpendicularity error between the circular and support axes, as modelled by a matrix $Md_2$; and thirdly, a port-hole effect, modelled by a matrix $Md_3$ and roll, pitch, and heading biases Br, Bt, and Bk.

The following are computed in succession: the components (a,b,c) of the director vector LV in the frame of reference of the head [t], then the components (a1,b1,c1) in the frame of reference of the support [s]. Thereafter the biases Br, Bt, and Bk are included to obtain the components (a2,b2,c2) in a frame of reference of the ship [b].

Finally, the components (x,y,z) of the vector LV are computed in the geographical frame of reference [g] by using the values of K, T, and R coming from the gyro unit. On the basis of the components (x,y,z) it is possible to compute true elevation and azimuth directly.

There is no need to describe the first stage in detail herein since it may be conventional, nor is there any need to describe calibration since that merely comprises performing measurements to determine differences between the real apparatus and the representation thereof by rotation matrices.

Tests have been performed that show that a system having a lateral axis with a servo-control passband for the elevation and lateral axes that is larger than its passband for the circular axis enables accurate aiming to be performed in azimuth and in elevation. It also makes it possible to maintain a constant azimuth rate. A system without a lateral axis still has high performance in elevation because of the second stage. Its azimuth rate performance and its azimuth aiming performance are not as satisfactory as in the first case, but real elevation and azimuth continue to be measured accurately.

Since the sensor is mounted on a fixed portion of the support, the image of the outside world projected on the sensor performs rotation about its own axis in time with the movements of the carrier and of the circular axis.

In a simple case, for a stationary carrier and aiming at zero elevation, the image of the outside world is projected on the sensor with rotation equal to rotation about the circular axis.

This phenomenon is well known and it is resolved by installing a de-rotator on the optical circuit serving to keep the image of a horizontal line horizontal. Control of the de-rotator is not described herein since it is comparable to that of conventional devices.

Figure 8:
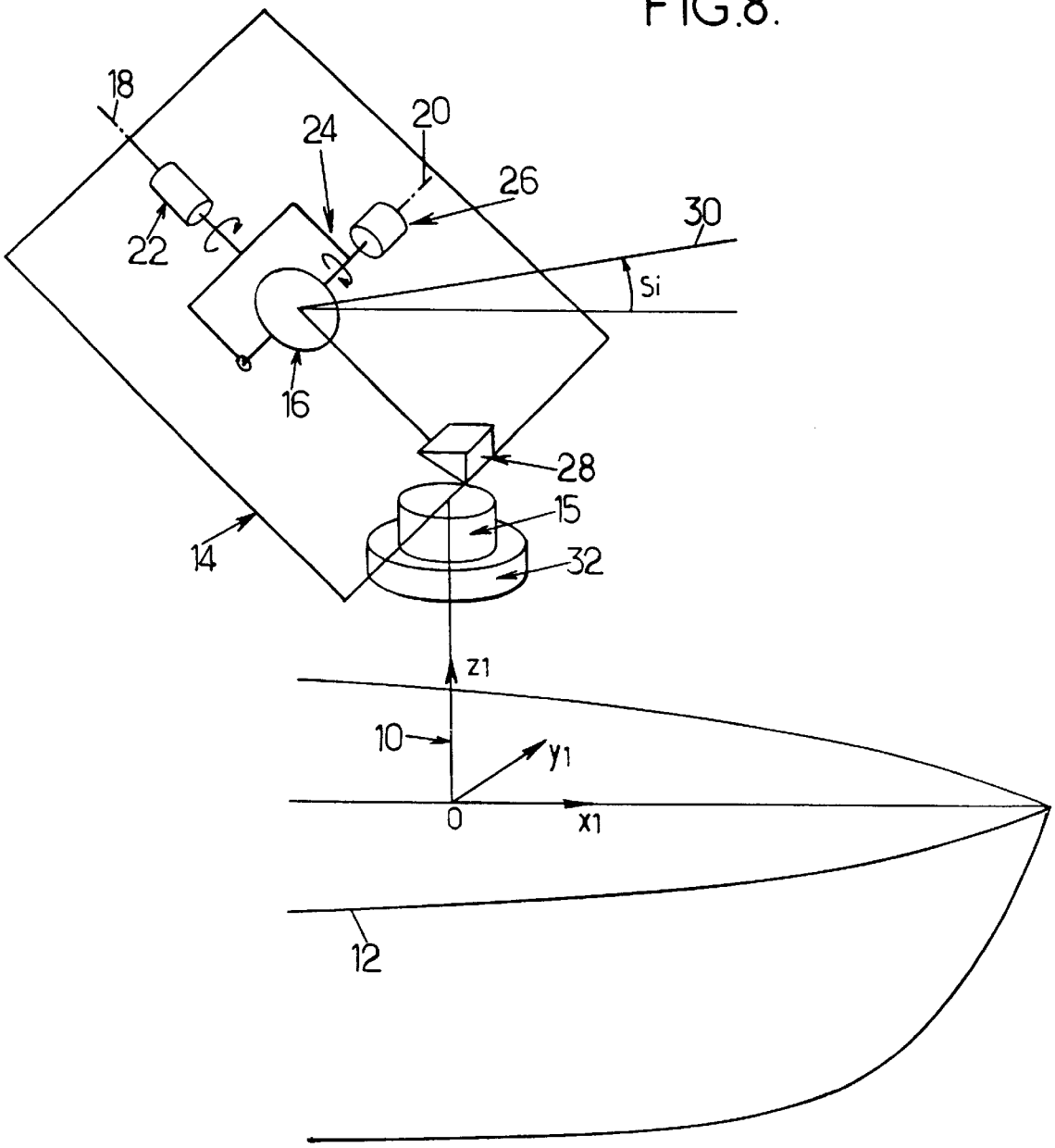
FIG. 8 shows a variant embodiment of the present invention.

FIG. 8 shows a modified embodiment of the system for performing panoramic surveillance at substantially constant elevation $S_i$, enabling a cone in three-dimensional space to be observed at almost constant scanning rate. Members corresponding to those shown in FIG. 1 are given the same reference numerals. The head 14 is rotated about the axis 18. The optical deflector assembly 28 is such that the axis 18 becomes functionally almost equivalent to a lateral axis while the axis 20 becomes almost equivalent to an elevation axis.

In this case, the sensor (not shown) fixed to the support may be constituted by an optoelectronic strip having a small angular field of view in the azimuth direction (e.g. a CCD strip). The device may then have a of probe pulses generator of probe pulses connected to the output of the computer unit and programmed cause reading of the photosensitive locations of the sensor at instants which correspond to equal azimuth intervals.

The computation and servo-control unit may also be programmed so as to repeat a servo-control and computation sequence in real time to maintain the elevation and azimuth set values, each sequence comprising three stages:

computing and servo-controlling the circular axis with a lateral angle equal to zero;

computing and servo-controlling the elevation axis and the lateral axis on the basis of the measured circular axis rotation; and determining the real elevation and azimuth angles of the sighting line (30) in order to deliver them to a user module, e.g. for displaying and/or processing images.

In yet another variant, the system does not have a lateral axis. The second computation stage is then applied to the elevation axis only, which device that only the elevation set value can be maintained accurately but which simplifies control. The unit is also designed to take account of imperfections by performing a product, for at least some of the rotation matrices representing orthonality defects between the axes and representing interfering optical defections.

We claim:

1. A stabilized sighting system having:

sight means including an aiming mirror apt to be steered by control motors about an elevation axis and about a circular axis, said circular axis being relative to a support, said control motors being driven for deflecting a light beam received along a set sighting line in a geographical frame of reference (x, y, z) by amounts such that said beam is directed along the circular axis, measurement means for measuring real angles imparted to said aiming mirror by said control motors about said circular axis and about an elevation axis, a gyro unit carried by said support and arranged for continuously supplying data enabling conversion of an angular position in the geographical framer of reference (x, y, z) to a position in a frame of reference tied to said support (x1, y1, z1); and a computer and servo-control unit for computing an actual angular position of the sighting line from information provided by said measurement means and from stored parameters modelling at least optical and mechanical defects of the sighting system, for transmitting said actual angular position to a user device and for controlling said control motors based on information received from said gyro unit and from said measurement means.

2. A system according to claim 1, for panoramic surveillance at constant elevation and at substantially constant azimuth scanning rate, wherein said sight device has a strip of optoelectronic sensors having a very small angular field of view about said circular axis as compared with a field of view in elevation and said computer and servo-control unit is programmed to generate probe pulses for causing the sensors to be read at instants which correspond to equal angular intervals about the circular axis.

3. A system according to claim 1, further having a lateral control motor for rotating said mirror about a lateral axis and measurement means for measuring real angles imparted by said lateral control motor about the lateral axis, wherein the computer and servo-control unit is programmed to repeat a servo-control and computation sequence in real time to maintain the sighting line at set elevation value and a set azimuth value, each sequence comprising:

(a) computing an angle of rotation about said circular axis assuming that an angle about the lateral axis is zero and servo-controlling the control motor for steering about the circular axis;

(b) computing set values of angles of rotation to be given about the elevation axis and about the lateral axis based on a measured value of an amount of rotation about the circular axis and servo-controlling the elevation control motor and the lateral control motor; and (c) computing actual values of the elevation of azimuth angles of the sighting line and delivering them to a user module.

4. A system according to claim 3, wherein said user module comprises means for displaying and processing images.

5. A system according to claim 3, wherein the computer and servo-control unit is designed to take account of said stored parameters by performing a product of at least some of a plurality of rotation matrices representing deviation from orthogonality between the elevation axis and the circular axis of the system and parasitic optical deflections due to optical components of the system.

6. A stabilized sighting system for performing panoramic surveillance at a substantially constant set elevation angle, having:

(a) a carrier prone to move angularly in a geographical frame of reference;

(b) sight device including:

a head mounted on said carrier for panoramic movement about a circular axis, a first motor for rotating said head about said circular axis, a support rotatable in said head by a second motor about an axis located at a predetermined set angle with said circular axis, an aiming mirror rotatable by a third motor on said support about an axis orthogonal to said axis having an angle with said circular axis, light deflecting means fixed in said head for receiving input light reflected by said mirror and deflecting said light along said circular axis, (c) measurement means for measuring real angles imparted to said mirror by said first, second and third motors;

(d) a gyro unit arranged for continuously supplying data enabling conversion of any angular position in the geographical frame of reference to an angular position in a frame of reference tied to said carrier;

(e) means for deriving set values of the angles to be given to said mirror by said second and third motors for causing an input light beam received along said set elevation angle to be deflected along said circular axis from actual values of the angle about said circular axis and from said data and for driving said second and third motors; and (f) device for computing an actual angular position of the sighting line within said geographical frame of reference from information provided by said measurement device and from stored parameters modelling at least optical and mechanical defects of the sighting systems and for transmitting said actual angular position to a user's device.

* * * * *